United States Patent [19]

Nakano et al.

[11] Patent Number: 4,972,820

[45] Date of Patent: Nov. 27, 1990

[54] FUEL SUPPLY CONTROL SYSTEM FOR INTERNAL COMBUSTION ENGINES AT ACCELERATION

[75] Inventors: Kenji Nakano; Shigetaka Kuroda, both of Wako, Japan

[73] Assignee: Honda Giken Kogyo K.K., Tokyo, Japan

[21] Appl. No.: 383,737

[22] Filed: Jul. 21, 1989

[30] Foreign Application Priority Data

Aug. 3, 1988 [JP] Japan ..... 63-193626

[51] Int. Cl.[5] ..... F02D 41/10

[52] U.S. Cl. ..... 123/492

[58] Field of Search ..... 123/492, 422

[56] References Cited

U.S. PATENT DOCUMENTS 4,561,403 12/1985 Oyama et al. ..... 123/492 X 4,725,954 2/1988 Takao et al. ..... 123/492 X 4,771,752 9/1988 Nishimura et al. ..... 123/492 X

FOREIGN PATENT DOCUMENTS 3458 1/1985 Japan .

*Primary Examiner*—Tony M. Argenbright

*Attorney, Agent, or Firm*—Arthur L. Lessler

[57] ABSTRACT

A fuel supply control system for an internal combustion engine in which an accelerating fuel increment of fuel supplied to the engine is set in response to the detected change rate in the opening degree of the throttle valve. Further, the accelerating fuel increment is set in such a manner that it is smaller as the detected reduction gear ratio of the transmission is larger. Advantageously, the accelerating fuel increment is set to increase at a smaller rate as the above detected change increases within a region within which the change rate is smaller than a region in which the change rate is larger.

7 Claims, 5 Drawing Sheets

| FIG. 2A | FIG. 2B | FIG. 2C |
|---|---|---|

FUEL SUPPLY CONTROL SYSTEM FOR INTERNAL COMBUSTION ENGINES AT ACCELERATION

BACKGROUND OF THE INVENTION

This invention relates to a fuel supply control system for internal combustion engines at acceleration, and more particularly to a control system of this kind which can properly control an accelerating increment of fuel supplied to the engine during acceleration in dependence on the reduction gear ratio of a transmission connected to the engine.

A fuel supply control method of this kind has conventionally been proposed, e.g., by Japanese Provisional Patent Publication (Kokai) No. 60-3458, which determines an accelerating increment of fuel supplied to an internal combustion engine when the engine is in a predetermined accelerating condition, by selecting a table from among a group of tables of accelerating fuel increments, depending upon whether or not interruption of fuel supply (fuel cut) was effected immediately before the engine enters the predetermined accelerating condition as well as upon the rotational speed of the engine, and reading an accelerating fuel increment from the selected table in accordance with a rate of change in the opening degree of the throttle valve, to thereby obtain good driveability of the engine satisfying the driver's demand for acceleration.

However, the proposed method has the disadvantage that when it is applied to an engine which is designed to provide high torque even in a low rotational speed region, desired driveability of the engine cannot be obtained over a wide range of the reduction gear ratio assumed by a transmission connected to the engine.

In general, the degree of the driver's demand for acceleration of the vehicle varies depending upon an operating condition in which the engine is operating. Specifically, when the vehicle is running with a small reduction gear ratio of the transmission selected, i.e., with the transmission in a high speed gear position such as one of third through fifth speed, the driver usually wants the vehicle to exhibit high acceleration response and he heavily depresses the accelerator pedal to rapidly increase the opening degree of the throttle valve. On the other hand, when the vehicle is running with a large reduction gear ratio of the transmission selected, i.e., with the transmission in a low speed gear position such as first speed or second speed, the driver usually requires moderate acceleration of the vehicle so that he lightly depresses the accelerator pedal to slowly increase the opening degree of the throttle valve.

However, the proposed method does not contemplate the above-mentioned difference in required acceleration response depending upon the gear ratio. Therefore, when the proposed method is applied to an engine of the type providing high torque at low speeds, if the acceleration fuel increment is set so as for the engine to exhibit sufficient acceleration response when the transmission is in a high speed gear position, the acceleration response of the engine becomes excessively high when the transmission is in a low speed gear position even if the opening degree of the throttle valve is increased at a small rate, thereby causing unsmooth or awkward running of the vehicle as it is repeatedly accelerated and decelerated, e.g., in a traffic snarl, that is, degrading the driveability.

Conversely, if the accelerating fuel increment is set so as for the engine to exhibit moderate acceleration response when the transmission is in a low speed gear position, the engine will show insufficient acceleration response when the transmission is in a high speed gear position, thus failing to provide desired accelerability of the engine.

SUMMARY OF THE INVENTION

It is the object of the invention to provide a fuel supply control system for an internal combustion engine, which is capable of ensuring desired driveability of the vehicle over the entire range of the reduction gear ratio assumed by the transmission at acceleration of the engine, by eliminating unsmoothness in the running of the vehicle at a high reduction gear ratio while obtaining high acceleration response of the engine at a low reduction gear ratio.

According to the invention, there is provided a fuel supply control system for an internal combustion engine having an intake pipe, a throttle valve provided in the intake pipe, an output shaft, and transmission means connected to the output shaft, the fuel supply control system having first detecting means for detecting a change rate in the opening degree of the throttle valve, and accelerating fuel increment setting means for setting an accelerating increment of fuel supplied to the engine in response to the detected change rate in the opening degree of the throttle valve.

The fuel supply control system according to the invention is characterized by an improvement wherein the accelerating fuel increment setting means sets the accelerating fuel increment as a function of the throttle opening degree and a reduction ratio of the transmission means.

According to a first aspect of the invention, second detecting means detects a reduction gear ratio assumed by the transmission means, and the accelerating fuel increment setting means sets the accelerating fuel increment in a manner such that it is smaller as the detected reduction gear ratio of the transmission means is larger.

Preferably, the accelerating fuel increment setting means may set the accelerating fuel increment in a manner such that it increases at a smaller rate as the change rate in the opening degree of the throttle valve increases within a region in which the change rate is smaller than within a region in which the change rate is larger.

More preferably, the accelerating fuel increment setting means May set the accelerating fuel increment to a larger value as the rotational speed of the engine is higher.

According to a second aspect of the invention, second detecting means detects whether or not a reduction gear ratio assumed by the transmission means is larger than a predetermined ratio, and the accelerating fuel increment setting means sets the accelerating fuel increment in a manner such that the accelerating fuel increases at a smaller rate as the change rate in the opening degree of the throttle valve increases within a first region in which the change rate is smaller than within a second region in which the change rate is larger when the second detecting means detects that the reduction gear ratio assumed by the transmission means is larger than the predetermined ratio.

Preferably, the transmission means selectively assumes a first reduction ratio, and a second reduction ratio smaller than the first reduction ratio, both the first and second reduction ratios being larger than the predetermined ratio, the first and second regions being defined by a first buondary value of the change rate in the opening degree of the throttle valve when the first reduction ratio is assumed, while the first and second regions being defined by a second boundary value of the change rate which is larger than the first boundary value when the second reduction ratio is assumed.

More preferably, the accelerating fuel increment setting means may set the accelerating fuel increment to a smaller value as the transmission means assumes a larger reduction ratio insofar as it is larger than the predetermined ratio.

Once the accelerating fuel increment has been set to increase at a larger rate when the change rate in the opening degree of the throttle valve enters the second region, the increment may be continued to increase at the larger rate even when the change rate thereafter shifts into the first region.

The accelerating fuel increment setting means may set the accelerating fuel increment to a larger value as the rotational speed of the engine is higher, insofar as the reduction ratio assumed by the transmission means is larger than the predetermined ratio.

The above and other objects, features and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
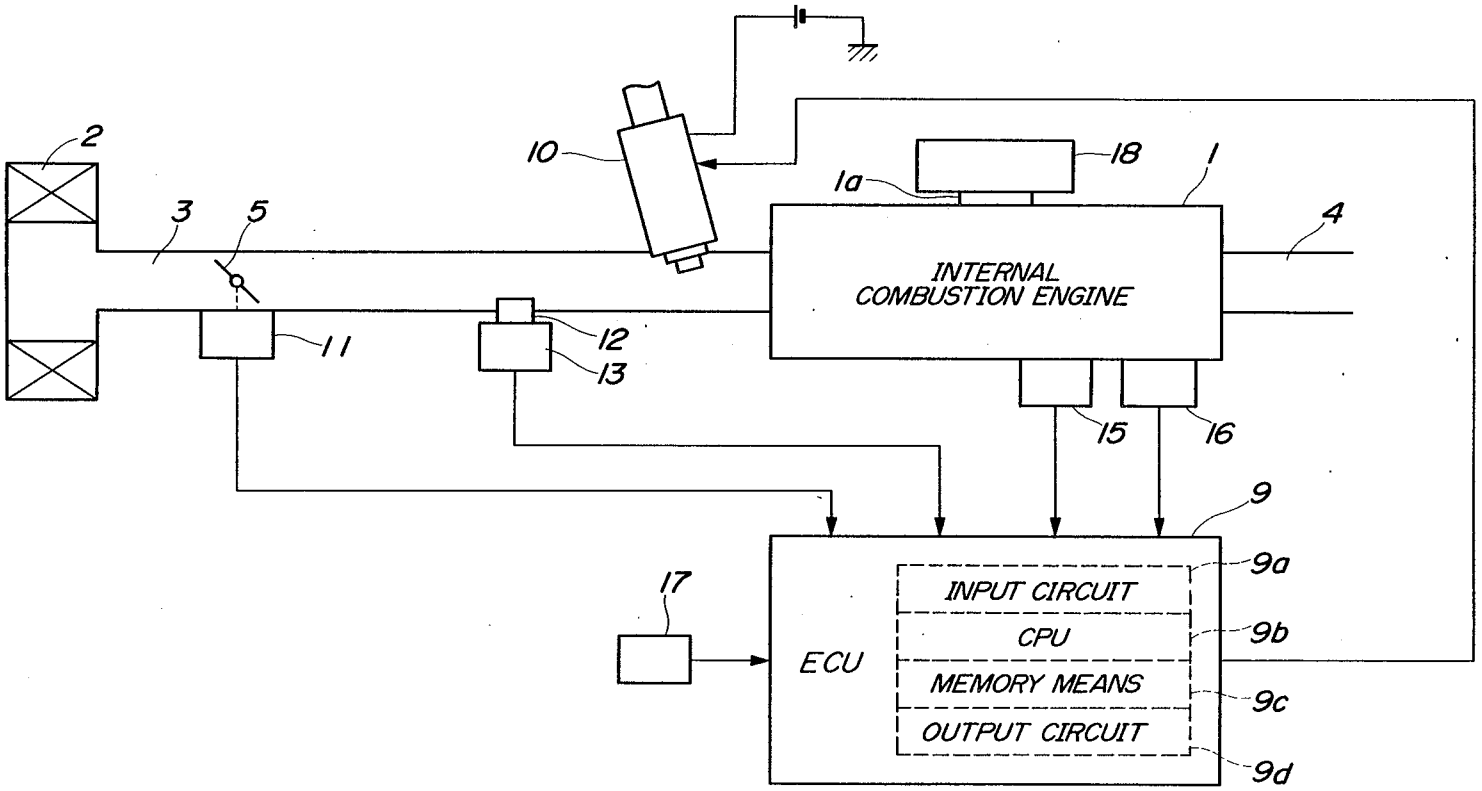
FIG. 1 is a block diagram showing the whole arrangement of a fuel supply control system for an internal combustion engine according to the invention.

Referring first to FIG. 1, there is shown the whole arrangement of a fuel supply control system for an internal combustion engine according to an embodiment of the invention. In the figure, reference numeral 1 represents an internal combustion engine 1, which may be a four-cylinder type, for example, and to which are connected an intake pipe 3 with an open end thereof provided with an air cleaner 2, and an exhaust pipe 4. A throttle valve 5 is arranged in the intake pipe 3 at an intermediate portion thereof.

Fuel injection valves 10, only one of which is shown, are inserted into the interior of the intake pipe 3 at locations intermediate between the cylinder block of the engine 1 and the throttle valve 5. The fuel injection valves 10 are connected to a fuel pump, not shown, and electrically connected to an electronic control unit (hereinafter referred to as "the ECU") 9 to have their valve opening periods controlled by control signals therefrom.

Connected to the throttle valve 5 is a throttle valve opening ($\theta_{TH}$) sensor 11 which cooperates with the ECU 9 to form valve opening degree detecting means and converts the sensed throttle valve opening into an electric signal and supplying same to the ECU 9. An intake pipe absolute pressure ($P_{BA}$) sensor 13 is communicated via a pipe 12 with the interior of the intake pipe 2 at a location downstream of the throttle valve 5, for sensing absolute pressure within the intake pipe 2 and supplying an electric signal indicative of the sensed absolute pressure to the ECU 9 to which it is electrically connected.

Arranged in facing relation to a camshaft, not shown, or a crankshaft 1a of the engine 1 is an engine rotational speed (Ne) sensor 16 for sensing the rotational speed of the engine, the sensor 16 being electrically connected to the ECU 9 for supplying an electric signal indicative of the sensed rotational speed thereto. The Ne sensor 16 is adapted to generate a pulse of a crank angle position signal (hereinafter called "the TDC signal") at each of predetermined crank angles in advance of a top dead center (TDC) corresponding to the start of a suction stroke of each of the cylinders whenever the engine crankshaft rotates through 180 degrees, the TDC signal being supplied to the ECU 9.

Further connected to the ECU 9 is a vehicle speed (V) sensor 17 for sensing the running speed V of the vehicle and generating pulses indicative of the sensed speed V, the pulses being supplied to the ECU 9.

Further, a transmission 18, which may be either a manual type or an automatic type, is connected to the crankshaft (output shaft) la of the engine 1.

In the embodiment, the ECU 9 comprises accelerating fuel increment setting means and second detecting means, as hereinafter referred to.

The respective signals indicative of sensed engine operating parameters are supplied from the above-mentioned sensors through the input circuit 9a to the CPU 9b of the ECU 9. The CPU 9b executes a control program, hereinafter described, to determine operating conditions of the engine 1 such as an accelerating condition, based upon the engine operating parameter signals, calculate an amount of fuel to be supplied to the engine 1, i.e., the fuel injection period $T_{OUT}$ of the fuel injection valves 10, based upon the determined operating conditions of the engine 1 by the use of the following equation (1), and supply driving signals resulting from the above calculation to the fuel injection valves 10 through the output circuit 9d:

$$T_{OUT}=Ti\times K_1+T_{ACC}\times K_2+K_3 \quad (1)$$

where Ti represents a basic value of the fuel injection period for the fuel injection valves 10, which is determined as a function of the intake pipe absolute pressure $P_{BA}$ and the engine rotational speed Ne, for example.

$T_{ACC}$ represents a correction variable for correcting the amount of fuel supplied to the engine 1 during acceleration of same, which is determined by a subroutine, hereinafter described with reference to FIG. 2. $K_1$, $K_2$, and $K_3$ are correction coefficients and correction variables, respectively, which are calculated based upon values of engine operation parameter signals from various sensors as aforementioned so as to optimize operating characteristics of the engine such as fuel consumption, and accelerability.

The CPU 9b operates on the fuel injection period $T_{OUT}$ determined as above to supply corresponding driving signals to the fuel injection valves 10 to drive same.

Figures 2, 2A:
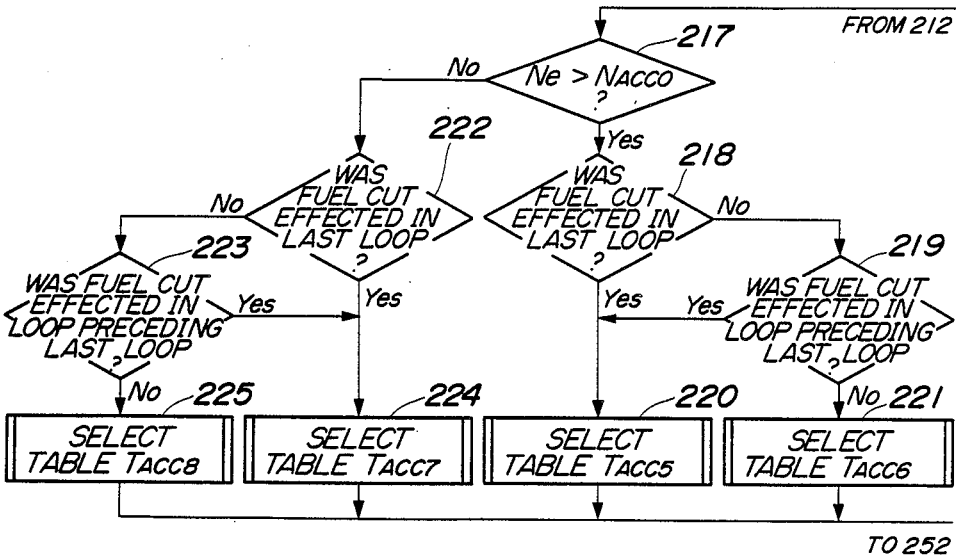
FIGS. 2(A-C) are a flowchart of a subroutine for determining a correction variable $T_{ACC}$ used for obtaining accelerating fuel increment.
Figure 2B:
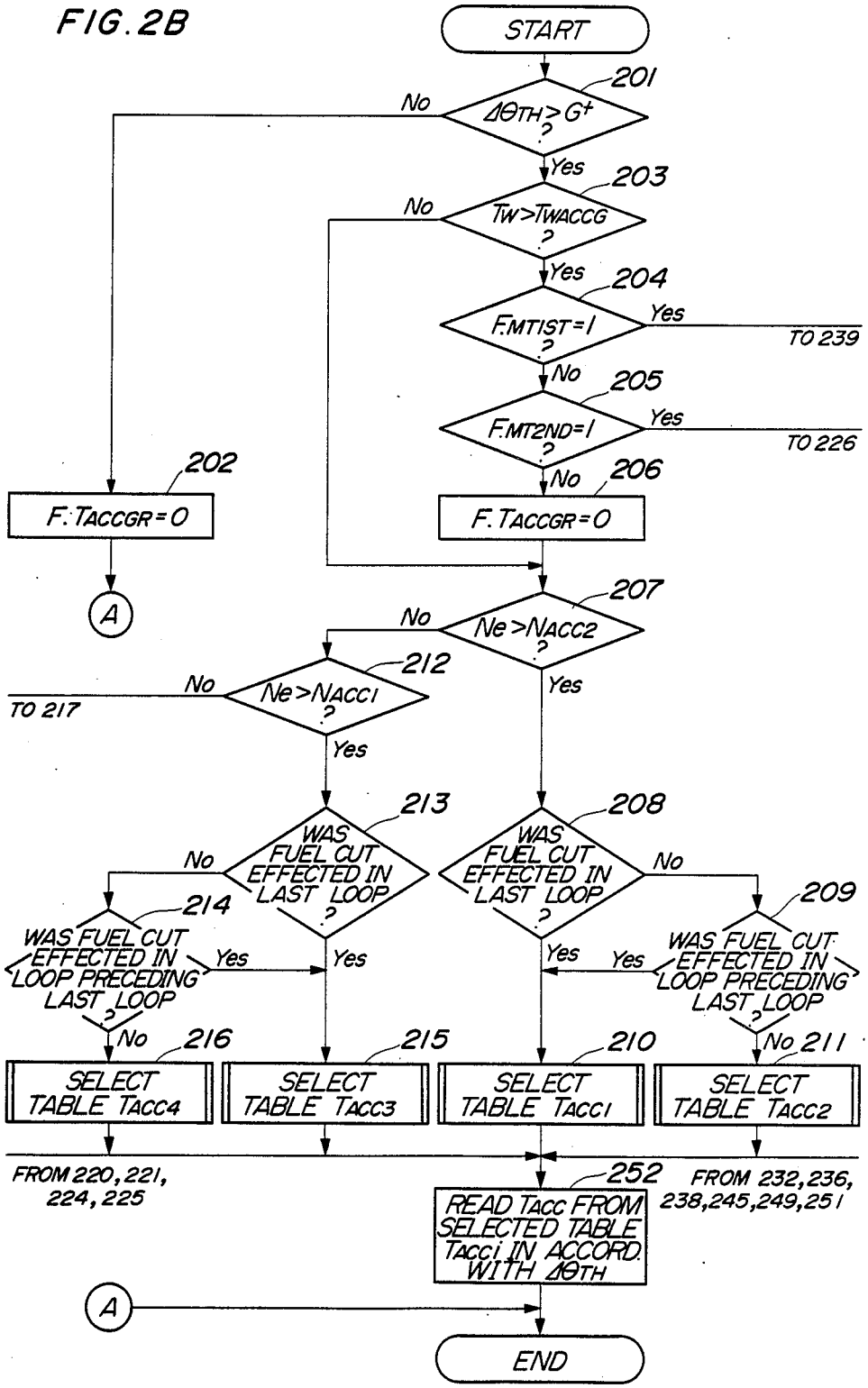
Figure 2C:
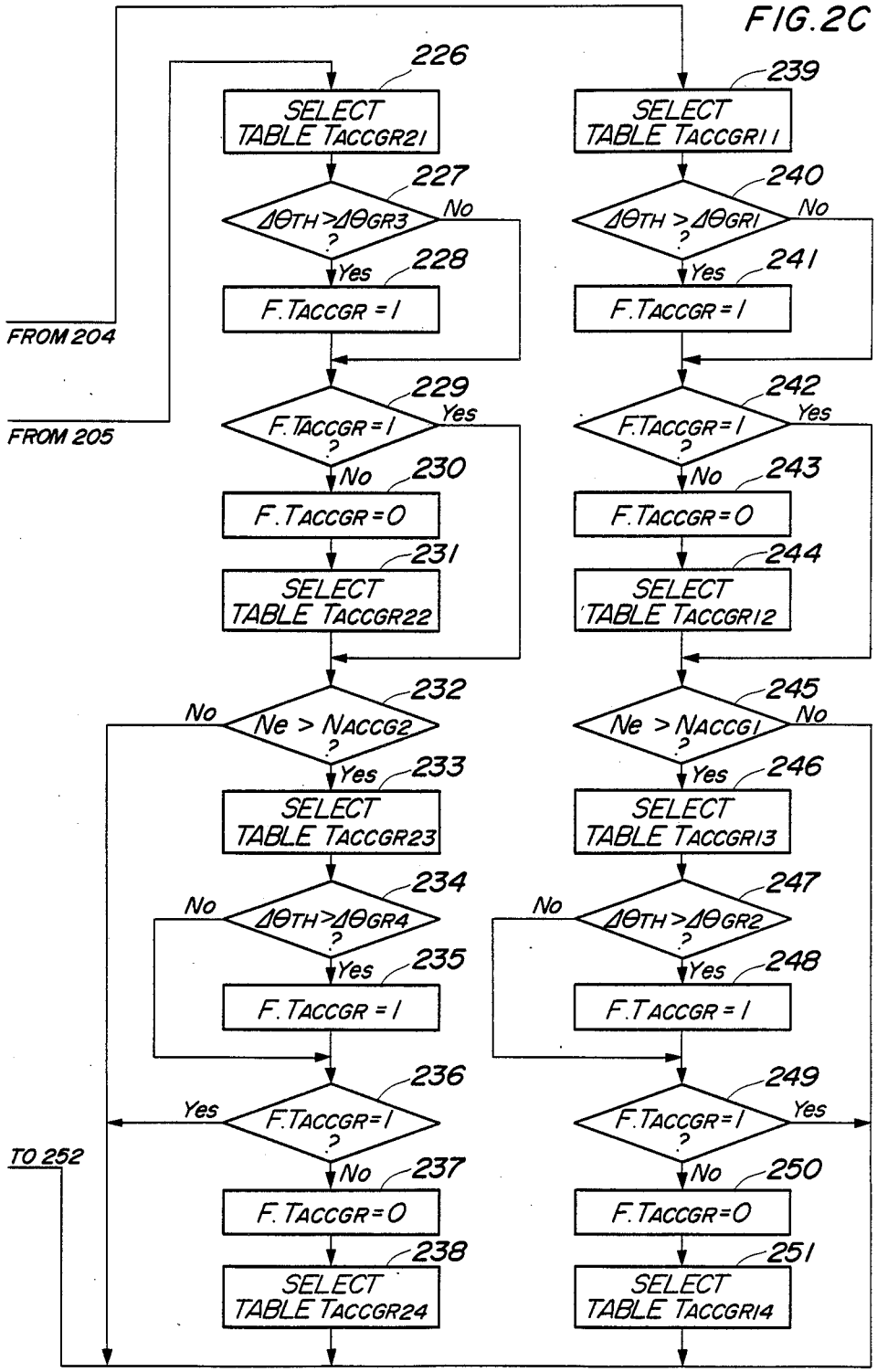

FIG. 2 shows a program for calculating the correction variable $T_{ACC}$, which is executed in the CPU 9 upon generation of pulses of the TDC signal and in synchronism therewith.

First, at a step 201, it is determined whether or not a rate of change in the opening degree (hereinafter referred merely to as "change rate") $\theta_{TH}$ of the throttle valve 5 is larger than a predetermined value G+, e.g., +0.6 degrees per TDC signal pulse, for discriminating acceleration of the engine. The change rate $\Delta\theta_{TH}$ is determined as a difference ($\Delta\theta_{TH} = \theta_{THn} - \theta_{THn-1}$) in throttle valve opening degree between the present loop and the immediately preceding loop, i.e., between generation of the present TDC signal pulse and that of the immediately preceding TDC signal pulse.

If the answer to the question of the step 201 is negative or No, that is, if $\Delta\theta_{TH} < G+$ is satisfied, it is judged that the engine 1 is not in a predetermined accelerating condition, and then a first flag $F.T_{ACCGR}$ is set to 0 at a step 202, followed by terminating the present program.

On the other hand, if the answer to the question of the step 201 is affirmative or Yes, that is, if $\theta_{TH} > G+$ is satisfied, it is determined at a step 203 whether or not the engine coolant temperature $T_W$ is higher than a predetermined value $T_{WACCG}$, e.g., 75° C. If the answer is negative or No, that is, if $T_W \leqq T_{WACCG}$ is satisfied, the program jumps to a step 207, whereas if the answer is affirmative or Yes, it is determined at a step 204 whether or not a second flag $F._{MT1ST}$ has been set to 1. The second flag $F._{MT1ST}$ is set to 1 by a subroutine, not shown, based upon the relationship between the engine rotational speed Ne and the vehicle speed V, i.e., it is set to 1 when it is determined that the transmission 18 is in a first speed gear position. If the answer to the question of the step 204 is negative or No, that is, if the transmission is not in the first speed gear position, it is determined at a step 205 whether or not a third flag $F._{MT2ND}$ has been set to 1. The third flag $F._{MT2ND}$ is set to 1, in a manner similar to the setting of the second flag $F._{MT1ST}$, when the transmission is in a second speed gear position. If the answer to the question of the step 205 is negative or No, that is, if the transmission is in a higher speed gear position than the first and second speed gear positions, the first flag $F.T_{ACCGR}$ is set to 0 at a step 206, and then the program proceeds to steps 207 et seq.

Steps 207 through 225 are for selecting one table from a group of tables $T_{ACCi}$ (i=1-8) for high speed gear positions, which each have values of the correction variable $T_{ACC}$ previously set in relation to the change rate $\Delta\theta_{TH}$, depending upon the engine rotational speed Ne as well as upon whether or not fuel cut was effected in the last loop or in the loop immediately preceding the last loop.

Specifically, at the step 207, it is determined whether or not the engine rotational speed Ne is higher than a third predetermined value $N_{ACC2}$, e.g., 3,000 rpm. If $Ne > N_{ACC2}$ is satisfied, it is determined whether or not fuel cut was effected in the last loop and in the loop immediately preceding the last loop, at steps 208 and 209, respectively. If one of the answers to the questions of these steps is affirmative or Yes, that is, if fuel cut was effected in either the last loop or the loop immediately preceding the last loop (hereinafter referred merely to as "if fuel cut was effected"), a table $T_{ACC1}$ is selected at a step 210, whereas if no fuel cut was effected in either of the last loop or the loop immediately preceding the last loop (hereinafter referred merely to as "if no fuel cut was effected"), a table $T_{ACC2}$ is selected at a step 211.

If $Ne < N_{ACC2}$ is satisfied at the step 207, steps 212 through 225 are executed in a manner similar to the above described steps 207 through 211. That is, at steps 212 through 216, if $N_{ACC1} < Ne < N_{ACC2}$ is satisfied, wherein $N_{ACC1}$ is a second predetermined value, e.g., 2,100 rpm, a table $T_{ACC3}$ is selected when fuel cut was effected, whereas a table $T_{ACC4}$ is selected when no fuel cut was effected. Similarly, at steps 217 through 221, if $N_{ACC0} < Ne < N_{ACC1}$ is satisfied, wherein $N_{ACC0}$ is a first predetermined value, e.g., 1400 rpm, a table $T_{ACC5}$ is selected when fuel cut was effected, whereas a table $T_{ACC6}$ is selected when no fuel cut was effected. Further, at steps 222 through 225, if $Ne < N_{ACC0}$ is satisfied, a table $T_{ACC7}$ is selected when fuel cut was effected, whereas a table $T_{ACC8}$ is selected when no fuel cut was effected.

Figure 3:
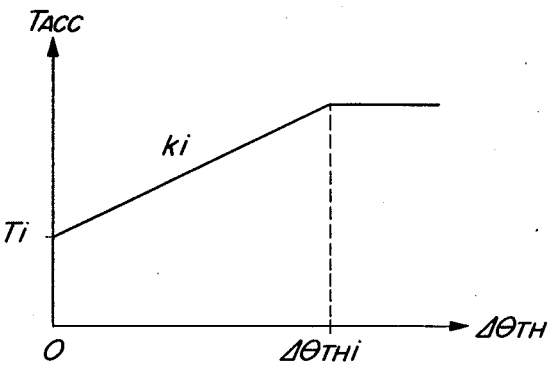
FIG. 3 is a diagram showing a table of the correction variable $T_{ACC}$, applied to the subroutine of FIG. 2 when the engine is operating with a low reduction gear ratio; and (a) and (b) of FIG. 4 are diagrams showing tables of the correction variable $T_{ACC}$ applied when the engine is operating with a high reduction gear ratio, wherein (a) shows an example that the value $T_{ACC}$ linearly varies discontinuously between rapid acceleration $\Delta\theta_{TH}>\theta_{GR3}$, $\Delta\theta_{GR1}$) and moderate acceleration ($\Delta\theta_{TH}<\Delta\theta_{GR3}$, $\Delta\theta_{GR1}$), and (b) shows an example that the value $T_{ACC}$ varies continuously between rapid acceleration ($\Delta\theta_{TH}\leqq\Delta\theta_{GR3}$, $\Delta\theta_{GR1}$) and moderate acceleration ($\Delta\theta_{TH}\leqq\Delta\theta_{GR3}$, $\Delta\theta_{GR1}$).

FIG. 3 shows an example of the tables $T_{ACCi}$ for high speed gear positions, wherein the correction variable $T_{ACC}$ has been set with respect to the change rate $\Delta\theta_{TH}$ such that it is equal to Ti when $\Delta\theta_{TH}$ assumes 0, linearly increases with a constant gradient of ki with increase in $\Delta\theta_{TH}$, and is held at a constant value when $\Delta\theta_{TH}$ assumes $\Delta\theta_{THi}$ or a larger value. By suitably setting the respective values of Ti, $\theta_{THi}$, and ki, a group of tables $T_{ACCi}$ are completed, which have respective different correction variable $T_{ACC}$ characteristies. The tables $T_{ACCi}$ set as above are selected in dependence on the engine roational speed Ne and whether or not fuel cut was effected, for reading therefrom values of correction variable $T_{ACC}$ best suited for accelerating conditions into which the engine 1 has shifted immediately before the present loop.

If the answer to the question of the step 205 is affirmative or Yes, that is, if $F._{MT2ND}=1$ is satisfied, which means that the transmission is in the second speed gear position, a table $T_{ACCGR21}$ for prompt acceleration at low engine rotational speed is selected as a second speed table at a step 226.

Figure 4:
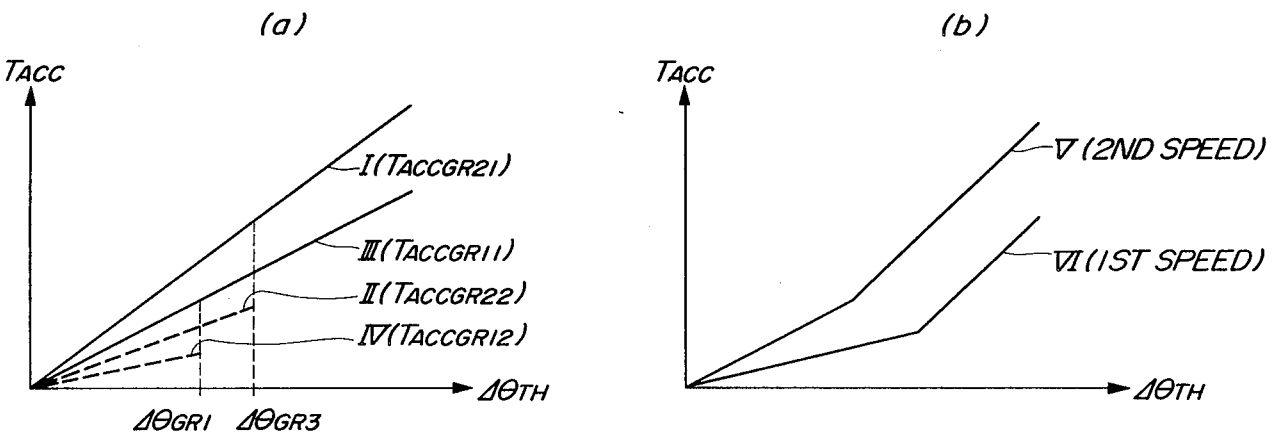

In (a) of FIG. 4, tables $T_{ACC}$ i for low speed gear positions are shown by way of examples, which each have the correction variable $T_{ACC}$ set based upon the gear position of the transmission and the degree of acceleration of the engine 1. Specifically, a table $T_{ACCGR21}$, shown by the solid line I, is used for prompt acceleration of the engine 1 at a low rotational speed when the transmission is in the second speed gear position, a table $T_{ACCGR11}$, shown by the solid line III, is used for prompt acceleration of the engine 1 at low rotational speed when the transmission is in the first speed gear position, a table $T_{ACCGR22}$, shown by the broken line II, is used for moderate acceleration of the engine 1 at low rotational speed when the transmission is in the second speed gear position, and a table $T_{ACCGR12}$, shown by the broken line IV, is used for moderate acceleration of the engine 1 at low rotational speed when the transmission is in the first speed gear position. In each of the tables $T_{ACCGR21}$, $T_{ACCGR11}$, $T_{ACCGR22}$, and $T_{ACCGR12}$, the correction variable $T_{ACC}$ is set such that it increases in proportion to increase in the change rate $\Delta\theta_{TH}$ along the corresponding straight line which passes the origin when $\Delta\theta_{TH}$ is 0. The table $T_{ACCGR21}$ for second speed (low speed) gear position has its correction variable $T_{ACC}$ set smaller than that of the tables $T_{ACCi}$ in FIG. 3 for high speed positions with respect to the same change rate $\Delta\theta_{TH}$. By thus setting the correction variable $T_{ACC}$, the accelerating fuel increment can be decreased when the engine 1 is accelerated with the transmission in a low speed gear position, thereby mitigating unsmoothness in the running of the vehicle as mentioned before.

Then, it is determined at a step 227 whether or not the change rate $\Delta\theta_{TH}$ is larger than a third predetermined value $\Delta\theta_{GR3}$, e.g., + degrees per TDC signal pulse. If $\Delta\theta_{TH} > \Delta\theta_{GR3}$ is satisfied, the first flag $F.T_{ACCGR}$ is set for 1 at a step 228, whereas if $\Delta\theta_{TH} \leqq \Delta\theta_{GR3}$ is satisfied, the program skips the step 228 over to a step 229, wherein it is determined whether or not the first flag $F.T_{ACCGR}$ has been set to 1. If the answer is negative or No, the first flag $F.T_{ACCGR}$ is set to 0 at a step 230, and the table $T_{ACCGR22}$ for moderate acceleration at low speed is selected in place of the table $T_{ACCGR21}$ at a step 231, whereas if the answer is affirmative or Yes, the program skips over the steps 230, 231 to a step 232, hereinafter referred to.

As shown in (a) of FIG. 4, the increasing rate or gradient ki of $T_{ACC}$ of the table $T_{ACCGR22}$ is lower than that of the table $T_{ACCGR21}$. That is, the increasing rate ki of the corretion variable $T_{ACC}$ is set lower in the range of $\Delta\theta < \Delta\theta_{GR3}$ wherein the change $\Delta\theta_{TH}$ is smaller, as compared with the increasing rate ki in the range of $\Delta\theta_{TH} > \Delta\theta_{GR3}$ wherein the change rate $\Delta\theta_{TH}$ is larger. Therefore, the accelerating fuel increment can be decreased when the engine is moderately accelerated with the transmission in the low speed gear position, thereby eliminating unsmoothness of running of the vehicle, which is encountered when the vehicle is alternately accelerated and decelerated in a traffic snarl, for example. On the other hand, when the engine 1 is promptly accelerated for standing start of the vehicle etc., the accelerating fuel increment can be increased to thereby obtain high accelerability of the engine 1.

Incidentally, immediately after the table $T_{ACCGR21}$ has been selected, even if the vehicle is shifted from a prompt accelerating state to a moderate accelerating state, that is, even if it is determined at the step 227 that $\Delta\theta_{TH} > \Delta\theta GR3$ is satisfied, and thereafter the change rate $\Delta\theta_{TH}$ decreases to satisfy $\Delta\theta_{TH} < \Delta\theta_{GR3}$, the first flag $F._{TACCGR}$ is maintained at 1 to continually render the answer to the question of the step 229 affirmative or Yes, so that the table $T_{ACCGR21}$ is continually selected.

At the step 232, it is determined whether or not the engine rotational speed Ne is higher than a predetermined value $N_{ACCG2}$, e.g., 1,500 rpm, for second speed gear position. If the answer to the question is negative or No, that is, if $Ne < N_{ACCG2}$ is satisfied, the program jumps to a step 252, hereinafter referred to, so that the selected table $T_{ACCGR21}$ or Table $T_{ACCGR22}$ is continually used.

On the other hand, if the answer to the question of the step 232 is affirmative or Yes, that is, if $Ne < N_{ACCG2}$ is satisfied and the engine 1 is in a high rotational speed state, a table $T_{ACCGR23}$, not shown, for prompt acceleration at high rotational speed is selected at a step 233. Then it is determined at a step 234 whether or not the change rate $\Delta\theta_{TH}$ is larger than a fourth predetermined value $\Delta\theta_{GR4}$, e.g., +28 degrees per TDC signal pulse. If the answer is affirmative or Yes, that is, if $\Delta\theta_{TH} > \Delta\theta_{GR4}$ is satisfied, the first flag $F.T_{ACCGR}$ is set to 1 at a step 235, whereas if the answer is negative or No, that is, if $\Delta\theta_{TH} \leqq \Delta\theta_{GR4}$ is satisfied, the program skips over the step 235 to a step 236. At the step 236, it is determined whether or not the first flag $F.T_{ACCGR}$ has been set to 1. If the answer is negative or No, the first flag $F.T_{ACCGR}$ is set to 0 at a step 237, and then the table $T_{ACCGR24}$, not shown, for moderate acceleration at high rotational speed is selected at a step 238, whereas if the answer is affirmative or Yes, the program skips over the steps 237, 238 to the step 252.

As described above, when the engine 1 is in the high rotational speed state to satisfy $Ne > N_{ACCG2}$, one of the table $T_{ACCGR23}$ and the table $T_{ACCGR24}$, which each have its correction variable $T_{ACC}$ set larger than those in the table $T_{ACCGR21}$ and the table $T_{ACCGR22}$, for engine low rotational speed is selected in place of the latter. By thus selecting tables, better accelerability can be obtained, thus enabling to satisfy the driver's demand for more prompt acceleration at high rotational speed of the engine 1 as compared with acceleration at low rotational speed of the engine 1.

If the answer to the question of the step 204 is affirmative or Yes, that is, if $F._{MT1ST}=1$ is satisfied, which means that the transmission is in the first speed gear position, a table $T_{ACC}$ for first speed gear position is selected at steps 239 through 251 in a similar manner to the steps 226 through 238 for second speed gear position. Specifically, a first predetermined value $\Delta\theta_{GR1}$, e.g., +28 degrees per TDC signal pulse, is used at the step 240 in place of the third predetermined value $\Delta\theta_{GR3}$ at the step 227, a predetermined value $N_{ACCG1}$, e.g., 2,000 rpm, for first speed gear position is used at a step 245 in place of the predetermined value $N_{ACCG2}$ at the step 232, and a second predetermined value $\Delta\theta_{GR2}$ e.g., +30 degrees per TDC signal pulse, is used at a step 247 in place of the fourth predetermined value $\Delta\theta_{GR4}$ at the step 234. If $Ne \leqq N_{ACCG1}$ is satisfied at the step 245, a table $T_{ACGR11}$ for prompt acceleration at low rotational speed is selected if $\Delta\theta_{TH} > \Delta\theta_{GR1}$ is satisfied at the step 240, while a table $T_{ACCGR12}$ for moderate acceleration at low roational speed is selected if $\Delta\theta \leqq \Delta\theta_{GR1}$ is satisfied at the step 240, as the table $T_{ACC}$ for first speed gear position.

As will be understood from (a) of FIG. 4, the table $T_{ACCGR11}$ and table $T_{ACCGR12}$ for first speed gear position have their correction variables $T_{ACC}$ set at lower increasing rates ki than those of the table $T_{ACCGR21}$ and table $T_{ACCGR22}$ for second speed gear position. By thus setting the tables $T_{ACCGR11}$ and $T_{ACCGR12}$, the vehicle can be free from unsmooth running when the engine 1 is moderately accelerated with the transmission in the low or first speed gear position, and at the same time high accelerability is obtained when the engine 1 is promptly accelerated with the transmission in the same gear position.

When $Ne > N_{ACCG1}$ is satisfied and at the same time $\Delta\theta_{TH} > \Delta\theta_{GR2}$ is satisfied, a table $T_{ACCGR13}$, not shown, is selected, wherein the correction variable $T_{ACC}$ is set larger than that in the table $T_{ACCGR11}$ for prompt acceleration at high rotational speed whereas if $Ne > N_{ACCG1}$ is satisfied and at the same time $\Delta\theta_{TH} < \Delta\theta_{GR2}$ is also satisfied, a table $T_{ACCGR14}$, not shown, is selected, wherein the correction variable $T_{ACC}$ is set larger than that in the table $T_{ACCGR12}$ for moderate acceleration at high rotational speed.

At the step 252, a value of the correction variable $T_{ACC}$ is read from a table $T_{ACCi}$ selected as above in accordance with the change rate $\Delta\theta_{TH}$, followed by terminating the program.

Incidentally, in the above described embodiment, two tables ($T_{ACCGR11}$ and $T_{ACCGR12}$ or $T_{ACCGR21}$ and $T_{ACCGR22}$) for each of first speed and second speed gear positions are selectively used depending upon whether the change rate $\Delta\theta_{TH}$ is larger than the predetermined value $\Delta\theta_{GR1}$ or $\Delta\theta_{GR2}$ so that the table value $T_{ACC}$ is discontinuous between when $\Delta\theta_{TH}>\Delta\theta_{GR1}$ or $\Delta\theta_{GR2}$ and when $\Delta\theta_{TH}\leqq\Delta\theta_{GR1}$ or $\Delta\theta_{GR2}$. The invention is not limited to the above, other various forms of table $T_{ACi}$ may be employed. For example, as shown in (b) of FIG. 4, the table $T_{ACCi}$ for first speed gear position as well as the table $T_{ACCi}$ for second speed gear position may be each formed by a single table in which the value $T_{ACC}$ linearly increases with increase of the change rate $\Delta\theta_{TH}$ at a higher increasing rate in the range of $\Delta\theta_{TH}>\Delta\theta_{GR1}$ or $\Delta\theta_{TH}>\Delta\theta_{GR2}$ than in the range of $\Delta\theta_{TH}<\Delta\theta_{GR1}$ or $\Delta\theta_{TH}\leqq\Delta\theta_{GR2}$.

Further, although the above described embodiment is applied to a transmission of the multistage type, wherein the reduction gear ratio is stepwise varied, but the invention may be applied also to a transmission of the infinitely variable speed type. If the invention is applied to this type transmission, the accelerating fuel increment may be determined by providing threshold values of change rate $\Delta\theta_{TH}$ for different values of reduction gear ratio, and selecting a table from a group of tables $T_{ACCi}$ similar to the tables in FIG. 4 by comparing between the actual reduction gear ratio with the threshold values. Alternnatively, the accelerating fuel increment may be determined as continuous values in accordance with the actual reduction gear ratio by the use of an equation which is to calculate the increment as a function of the reduction gear ratio and the change rate $\Delta\theta_{TH}$.

What is claimed is:

1. In a fuel supply control system for an internal combustion engine having an intake pipe, a throttle valve provided in said intake pipe, an output shaft, and transmission means connected to said output shaft, said fuel supply control system having first detecting means for detecting a change rate in the opening degree of said throttle valve, and accelerating fuel increment setting means for setting an accelerating increment of fuel supplied to said engine in response to the detected change rate in the opening degree of said throttle valve, the improvement comprising second detecting means for detecting whether or not a reduction gear ratio assumed by said transmission means is larger than a predetermined ration, wherein said accelerating fuel increment setting means set said accelerating fuel increment in a manner such that said accelerating fuel increases at a smaller rate as said change rate in the opening degree of said throttle valve increases within a first region in which the change rate is smaller than within a second region in which the change rate is larger when said second detecting means detects that the reduction gear ratio assumed by said transmission means is larger than said predetermined ratio.

2. A full supply control system as claimed in claim 1, wherein said transmission means selectively assumes a first reduction ratio, and a second reduction ratio smaller than said first reduction ratio, both said first and second reduction ratios being larger than said predetermined ratio, said first and second regions being defined by a first buondary value of said change rate in the opening degree of said throttle valve when said first reduction ratio is assumed, while said first and second regions being defined by a second boundary value of said change rate which is larger than said first boundary value when said second reduction ratio is assumed.

3. A fuel supply control system as claimed in claim 1, wherein said accelerating fuel increment setting means sets said accelerating fuel increment to a smaller value as said transmission means assumes a larger reduction ratio insofar as it is larger than said predetermined ratio.

4. A fuel supply control system as claimed in claim 1, wherein once said accelerating fuel increment has been set to increase at a larger rate when said change rate in the opening degree of said throttle valve enters said second region, said increment is continued to increase at said larger rate even when said change rate thereafter shifts into said first region.

5. A fuel supply control system as claimed in claim 1, wherein said accelerating fuel increment setting means sets said accelerating fuel increment to a larger value as the rotational speed of said engine is higher, insofar as said reduction ratio assumed by said transmission means is larger than said predetermined ratio.

6. In a fuel supply control system for an internal combustion engine having an intake pipe, a throttle valve provided in said intake pipe, an output shaft, and transmission means connected to said output shaft, said fuel supply control system having first detecting means for detecting a change rate in the opening degree of said throttle valve, and accelerating fuel increment setting means for setting an accelerating increment of fuel supplied to said engine in response to the detected change rate in the opening degree of said throttle valve, the improvement comprising second detecting means for detecting a reduction gear ratio assumed by said transmission means, and wherein said accelerating fuel increment setting means sets said accelerating fuel increment in a manner such that (i) it is smaller as the detected reduction gear ratio of said transmission means is larger and (ii) it increases at a smaller rate as said change rate in the opening degree of said throttle valve increases within a region in which the change rate is smaller than within a region in which the change rate is larger.

7. In a fuel supply control system for an internal combustion engine having an intake pipe, a throttle valve provided in said intake pipe, an output shaft, and transmission means connected to said output shaft, said fuel supply control system having first detecting means for detecting a change rate in the opening degree of said throttle valve, and accelerating fuel increment setting means for setting an accelerating increment of fuel supplied to said engine in response to the detected change rate in the opening degree of said throttle valve, the improvement comprising second detecting means for detecting a reduction gear ratio assumed by said transmission means, and wherein said accelerating fuel increment setting means sets said accelerating fuel increment in a manner such that it is smaller as the detected reduction gear ratio of said transmission means is larger, wherein said accelerating fuel increment setting means sets said accelerating fuel increment to a larger value as the roational speed of said engine increases.

* * * * *